US006502518B1

(12) United States Patent
Miller

(10) Patent No.: US 6,502,518 B1
(45) **Date of Patent: *Jan. 7, 2003**

(54) CONVERTED MULTIPLE HOPPER RAIL CAR AND METHOD FOR MAKING SAME

(75) Inventor: Roy W. Miller, Lake County, IN (US)

(73) Assignee: JAC Patent Company, Johnstown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/615,096

(22) Filed: Jul. 13, 2000

Related U.S. Application Data

(60) Provisional application No. 60/143,656, filed on Jul. 13, 1999.

(51) Int. Cl.[7] ..... B61D 7/00

(52) U.S. Cl. ..... 105/248; 105/247; 105/355; 105/396; 105/404; 52/17; 403/271

(58) Field of Search ..... 105/238.1, 247, 105/248, 249, 355, 396, 404, 406.1, 409, 411; 403/270, 271, 272; 52/17, 730.1, 730.4

(56) References Cited

U.S. PATENT DOCUMENTS 1,224,050 A * 4/1917 Worth et al. ..... 105/248
2,041,407 A * 5/1936 Gllpin ..... 105/409
2,102,455 A * 12/1937 Bondsall ..... 105/409
2,211,375 A * 8/1940 Greulich ..... 105/247
3,521,575 A * 7/1970 Hannah ..... 105/409
3,842,756 A * 10/1974 Marulic ..... 105/480
4,062,297 A * 12/1977 Snyder et al. ..... 105/480
4,696,088 A * 9/1987 Miller ..... 29/401.1
4,696,237 A * 9/1987 Miller ..... 105/248
5,433,501 A * 7/1995 Thomas et al. ..... 105/409

* cited by examiner

*Primary Examiner*—S. Joseph Morano
*Assistant Examiner*—Frantz F. Jules
(74) *Attorney, Agent, or Firm*—Webb Ziesenheim Logsdon Orkin & Hanson, P.C.

(57) ABSTRACT

A dual hopper rail car is converted from a three-hopper rail car. The converted rail car includes a pair of hoppers with each hopper including a discharge opening for discharging contents of the hopper. A center sill, pair of top chords, a pair of side sills and a pair of side sheets extend along the length of the converted rail car and each includes a welded splice connection. The welded splice connection of each side sheet is adjacent and between a pair of side stakes with a tie plate extending between the pair of side stakes. The method of converting the three-hopper rail car to the two-hopper rail car includes: severing the three-hopper rail car into a first end section, a second end section and a center section that includes the center hopper and a portion of an adjacent hopper; removing the center section; and attaching the first end section to the second end section.

24 Claims, 10 Drawing Sheets

FIG. 2
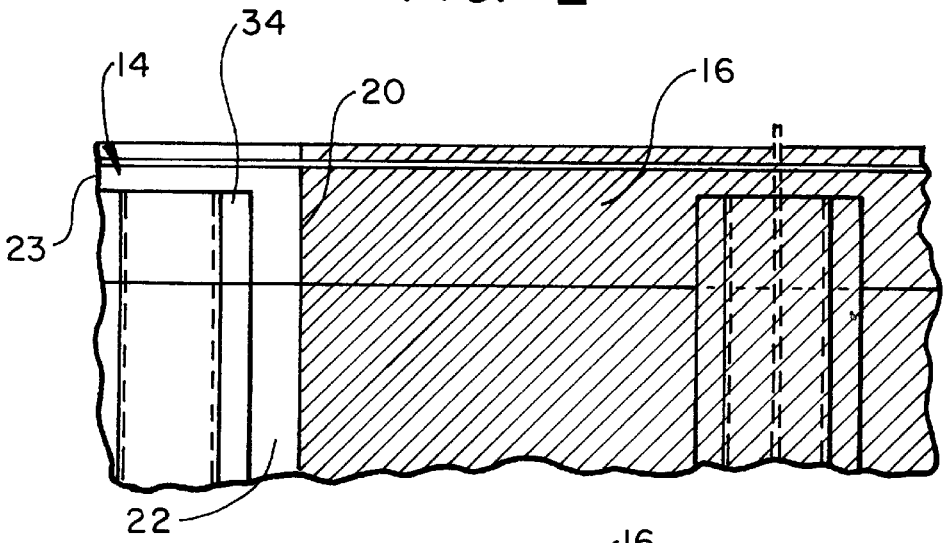
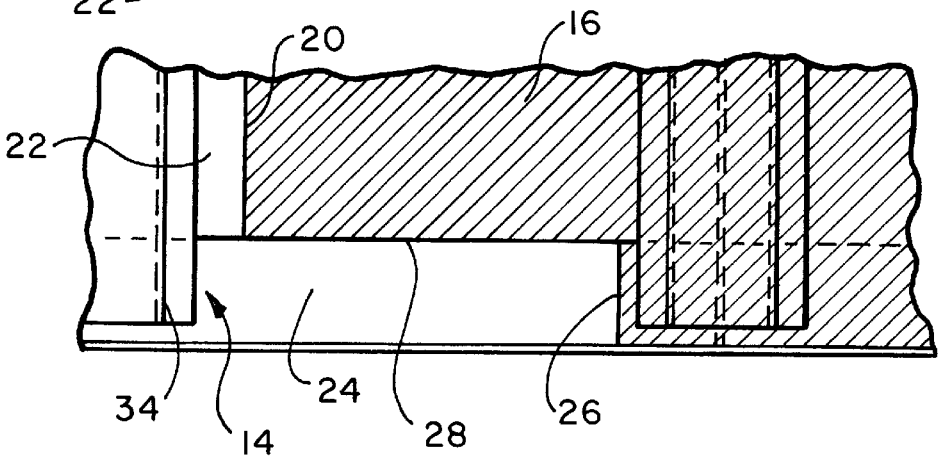
FIG. 3

CONVERTED MULTIPLE HOPPER RAIL CAR AND METHOD FOR MAKING SAME

This application claims the benefit of United States Provisional Patent Application Serial No. 60/143,656 filed on Jul. 13, 1999 entitled "Converted Multiple Hopper Rail Car and Method For Making Same", which is incorporated herein by reference.

BACKGROUND OF THE INVENTION

1. Field of the Invention

The present invention relates to multiple hopper rail cars and, more particularly, the present invention relates to a process of removing the center portion from a three-hopper 4,750 cubic foot capacity grain car and converting the rail car into a two-hopper 3,190 cubic foot capacity covered hopper rail car particularly suited for cement, aggregates, pearlite rock, ground slate and roofing granules.

2. Background Information

Covered multiple hopper cars of the type used to handle bulk shipments of particulate materials can be made in a wide range of sizes to accommodate different volumes of materials. However, in the interest of safety and to prevent overloading of tracks and bridges, limits are imposed on the gross loading of a rail car and its contents. Limits are also imposed on the overall height of a rail car and its load in order to keep the car's center of gravity within a prescribed limit.

The density of a particular product to be transported by a rail car can vary widely from low density plastic pellets having a density of about 28 pounds per cubic foot, to grain with a density of about 35 pounds per cubic foot and on to aggregate such as sand, gravel and cement having a density of about 90–100 pounds per cubic foot. To maximize load sizing and the efficiencies of handling, it has been common to build rail cars for specific commodities so that a specific approximate tonnage of a particular commodity can be transported in a single rail car. Thus, four-hopper rail cars are often used for handling light products, three-hopper rail cars are used for handling grain and two-hopper rail cars are used for handling cement, sand and gravel. Alternatively, a rail car can be manufactured which has smaller or larger hoppers, depending upon whether it is being designed to handle a certain weight of a high-density material or a low-density material.

A hopper rail car can have a useful life of 30–50 years. Therefore, it can and does happen that the existing stock of all types of hopper rail cars might periodically be out of balance with the current needs of a nation's economy.

This problem was addressed in my prior U.S. Pat. No. 4,696,237 (hereinafter "my '237 patent"), which is incorporated herein by reference. My '237 patent discloses a converted covered dual hopper rail car which is made by converting a rail car having three covered hoppers suitable for carrying a large volume of relatively low density commodity to a rail car having two hoppers suitable for carrying a relatively smaller volume of a high density commodity. Specifically, as disclosed in my '237 patent, this is accomplished by: internally bracing an interior portion of one end of one hopper end section; severing an unwanted center hopper section from the two end hopper sections; removing the unwanted section; and reassembling and welding the free sections to each other. My earlier '237 patent discloses that the vertical cutting and welding is horizontally offset at the upper side plate, and the side sill to provide a tab and notch locking arrangement for reinforcement. My '237 patent also teaches the need to provide roof loading hatches which are provided with downwardly extending collar portions which limit the maximum loading height within the converted hoppers.

My '237 patent was specifically directed toward the conversion of a 4,427 cubic foot capacity covered hopper rail car into a 3,148 cubic foot capacity rail car. Unfortunately, 4,427 cubic foot capacity covered hopper rail cars are not currently readily available and the resulting 3,148 cubic foot capacity rail car may not offer a maximum carrying capacity. There are several other significant problems with the converted rail car and method of my '237 patent. Most significantly, the outlets in the resulting car were not properly positioned, which then required adapters to be utilized at the unloading sites for the resulting converted rail car. The use of additional adapters makes the converted rail car somewhat impractical. Additionally, the assembly processing time associated with my earlier invention could be improved.

SUMMARY OF THE INVENTION

It is among the objects of the present invention to provide an improved converted hopper rail car suitable for carrying commodities such as cement, aggregates, pearlite rock, ground slate and roofing granules. It is another object of the present invention to provide an improved method of converting a multiple hopper rail car into a hopper rail car suitable for carrying commodities of a relatively heavy density. The foregoing and other objects and advantages are achieved by the converted hopper rail car and method of the present invention. In the present invention a center section of the multiple hopper rail car is completely severed and removed from a location between the two remaining end sections. The center section includes the entire center hopper section and a bulkhead portion of an adjacent end hopper section. The length of the removed center section permits the re-use of the center sloped sheets from the rail car. The remaining portions of the end hopper sections, which were located adjacent the removed center section, are then reassembled and welded together. As noted above, the removed center section includes the center hopper and the bulkhead portion of an adjacent hopper section such that certain extension members are added to the existing bulkhead prior to welding of the remaining sections or end hopper portions together. The present invention also replaces the outlet gates and changes the slope of certain bottom sheets to properly position the outlet gate. The present invention positions the cut line of the side sheets such that the side stakes are adjacent the welded splice connection and the splice connection is reinforced.

These and other advantages of the present invention will be clarified in the detailed description of the preferred embodiment taken together with the attached figures wherein like reference numerals represent like elements throughout.

BRIEF DESCRIPTION OF THE DRAWINGS

FIG. 2 is an enlarged view of the top left hand severing line illustrated in the three-hopper rail car of FIG. 1;

FIG. 3 is an enlarged view of the bottom left-hand severing line illustrated in the three-hopper rail car of FIG. 1;

DETAILED DESCRIPTION OF THE PREFERRED EMBODIMENT

Figure 1:
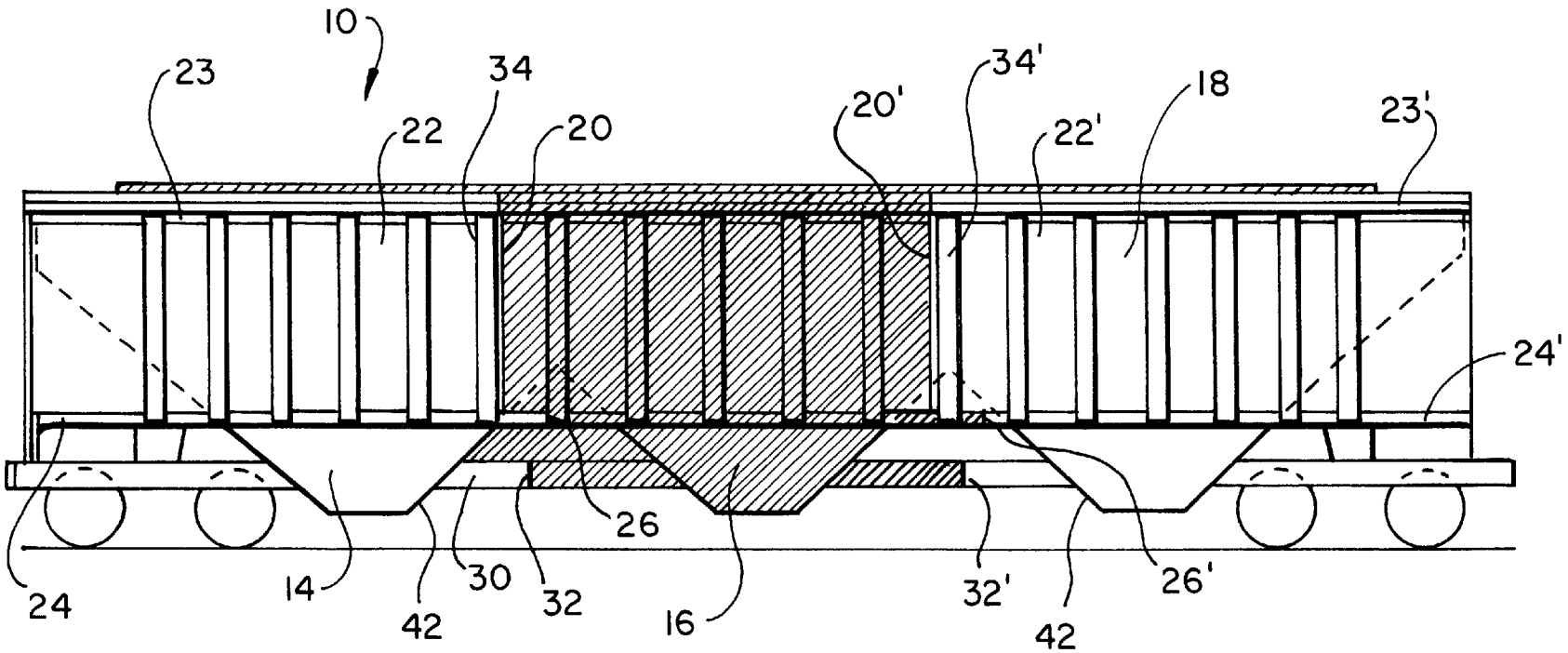
FIG. 1 is a side view of a three-hopper rail car with the center portion to be removed indicated by cross-hatching.
Figure 4:
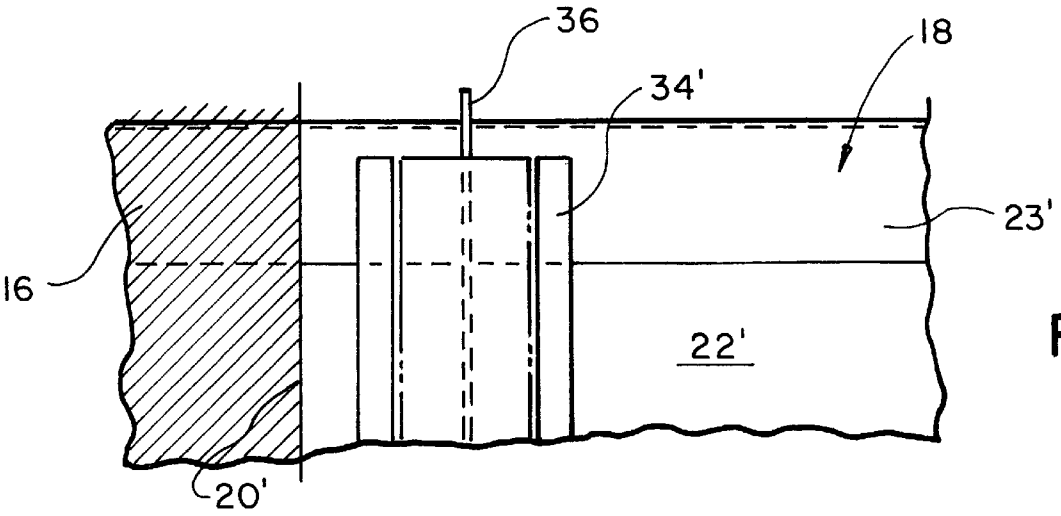
FIG. 4 is an enlarged view of the top right-hand severing line illustrated in the three-hopper rail car of FIG. 1.
Figure 14:
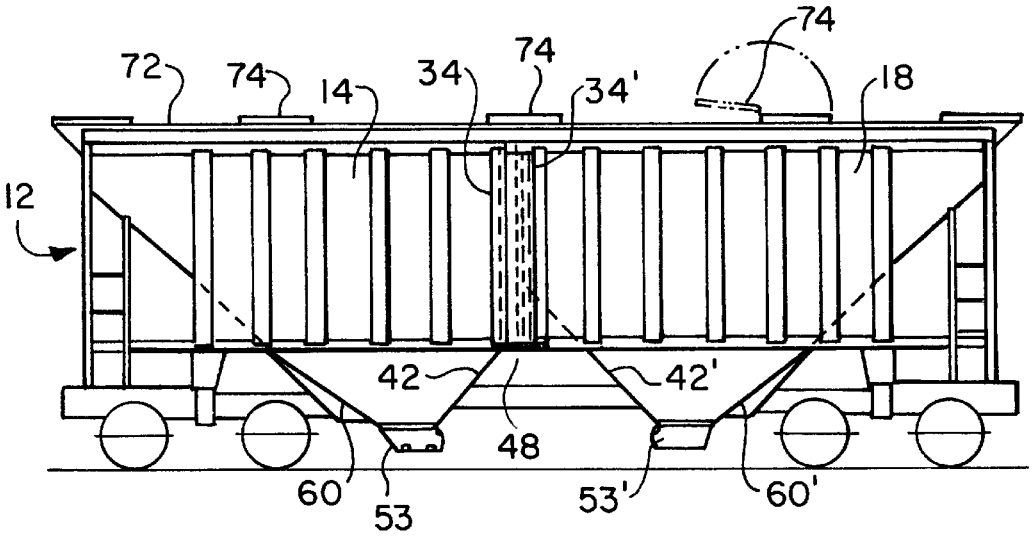
FIG. 14 is a side view of the assembled converted rail car according to the present invention.
Figure 16:
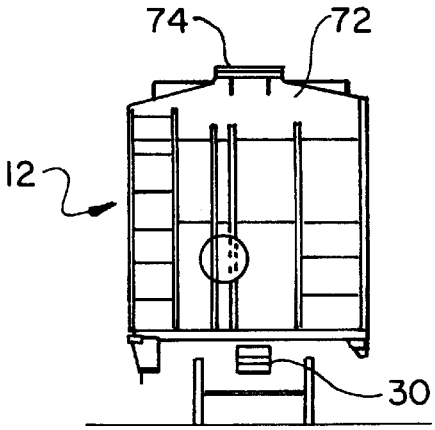
FIG. 16 is an end view of the rail car illustrated in FIG. 14.

FIG. 1 illustrates a 4,750 cubic foot capacity covered hopper rail car indicated generally at 10 which is to be converted in accordance with the method of the present invention into the 3,190 cubic foot capacity converted rail car indicated generally at 12 in FIG. 14. Basically, the conversion involves severing rail car 10 into three sections 14, 16 and 18, removing center section 16, which is shown in cross hatching in FIG. 1, and then reassembling and welding end sections 14 and 18 together. As discussed in my '237 patent, to insure maximum strength for the converted rail car 12, the rail car 10 should be severed very carefully when removing the center section 16. For example, as seen in FIGS. 1–5, the vertical cuts at each end of section 16 should not all be in a common vertical line. Rather, the vertical cut lines 20 and 20' in the side sheet 22 and 22' and in the top chord 23 and 23', respectively, should be offset from the vertical cut lines 26 and 26' in the side sill 24 and 24' to provide a tab and notch arrangement, as shown. Horizontal cuts 28 and 28' connect the respective vertical cuts. The center sill 30 and 30' should also have offset cut lines 32 and 32' as shown in FIG. 1. As shown in the Figures, the prime elements represent elements in the right-hand severed sections 18 which are similar to like numbered elements in section 14.

Figure 5:
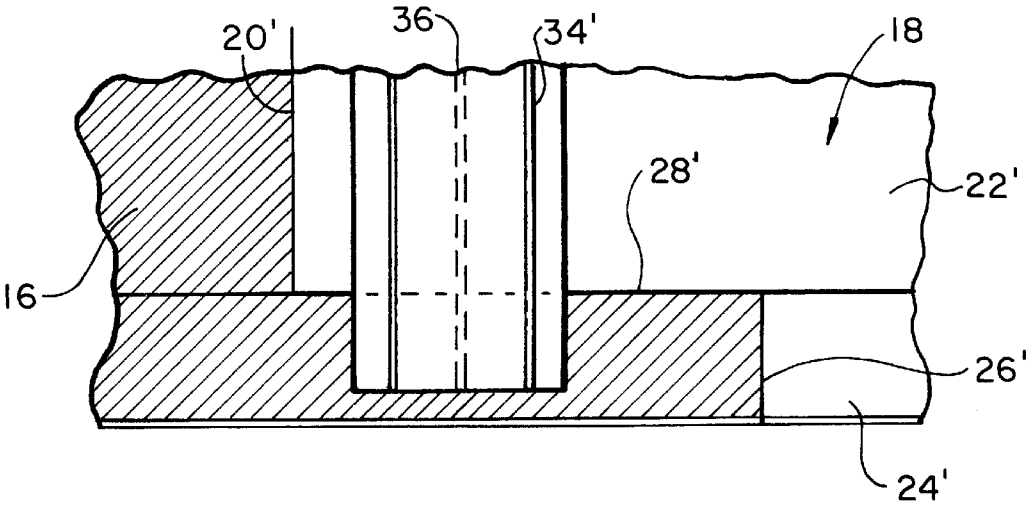
FIG. 5 is an enlarged view of the bottom right hand severing line illustrated in the three-hopper rail car of FIG. 1.
Figure 8:
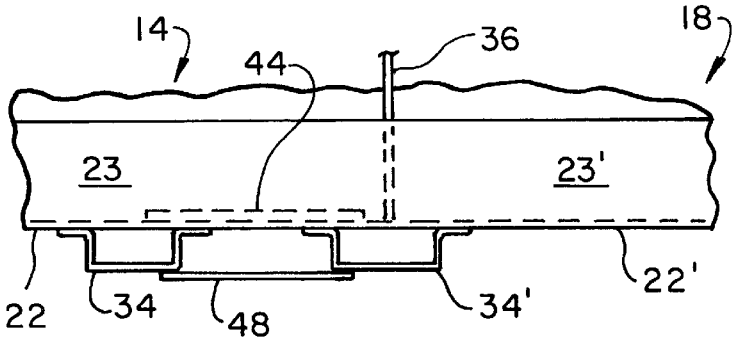
FIG. 8 is a plan view of the side plate splice in the converted rail car according to the present invention.
Figure 9:
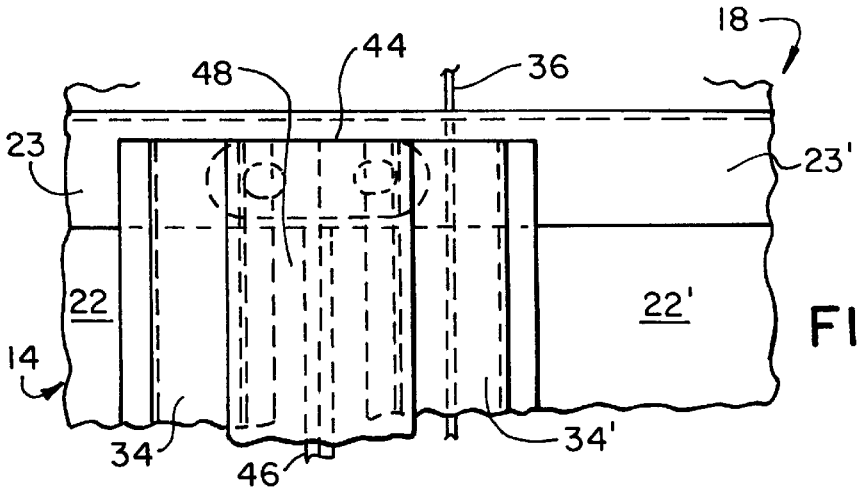
FIG. 9 is a side view of a top portion of the side plate splice in the converted rail car according to the present invention.
Figure 10:
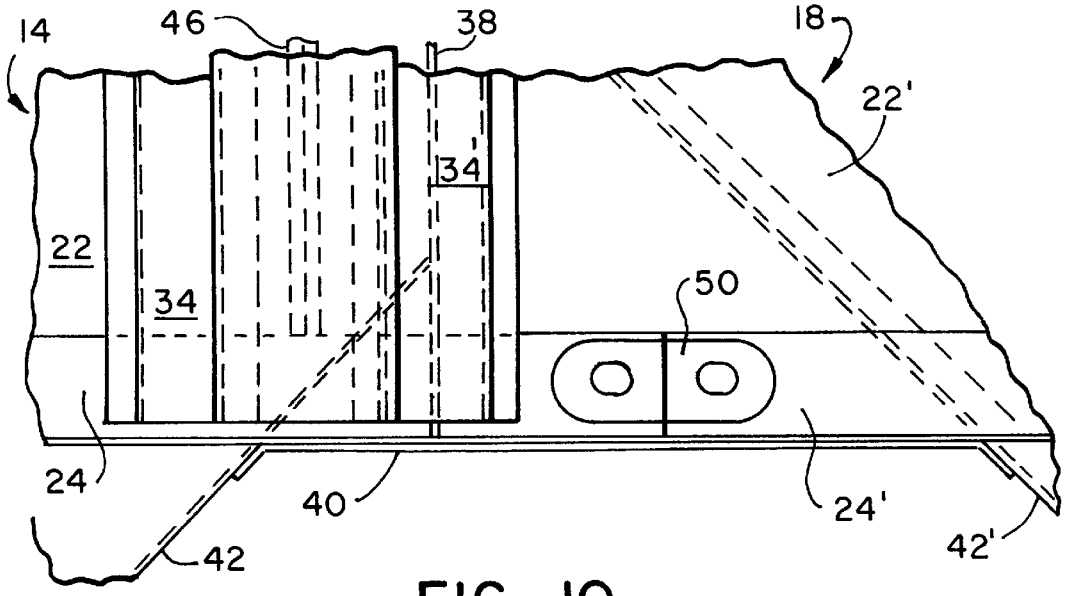
FIG. 10 is a side view of a bottom portion of the side plate splice in the converted rail car according to the present invention.

The center section 16 to be removed differs from the section removed in my '237 patent in several respects. First my '237 patent essentially simply removed the center hopper. In the present invention, the center section 16 includes the center hopper and a portion of the left-hand hopper of FIG. 1. The center section 16 is selected to properly position the outlets of the converted rail car 12 and to allow the re-use of the center sloped sheets of the rail car 10 in the converted rail car 12. Additionally, my '237 patent required the removal of several side stakes, one of which was reattached over the connection seam. In the present invention, the vertical cuts 20 and 20' are positioned adjacent side stakes 34 and 34', such that two side stakes 34 and 34' will be positioned adjacent the connecting seam as shown in FIGS. 8–10. The weld between the side stake 34 and the side sill 24 below the horizontal cut 28' as shown in FIG. 5 is also cut prior to removal of the center section 16. After severing the center section 16, the center section 16 can be removed by a crane as described in my '237 patent. The remaining sections 14 and 18 can be supported prior to reattachment, as generally described in my '237 patent.

Figure 6:
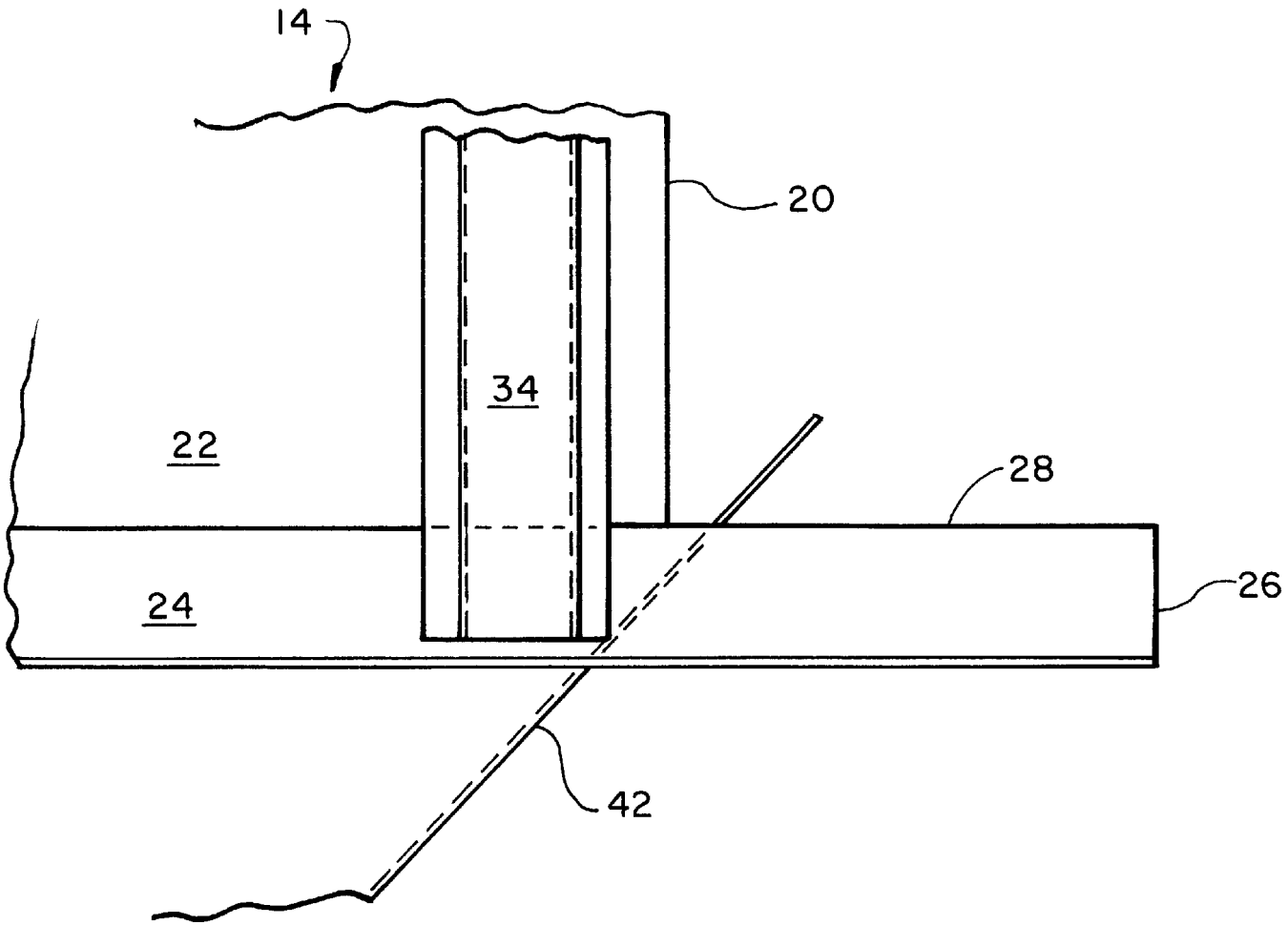
FIG. 6 is a sectional side view schematically illustrating the left section or end hopper after removal of the severed center portion shown in FIG. 1.
Figure 7:
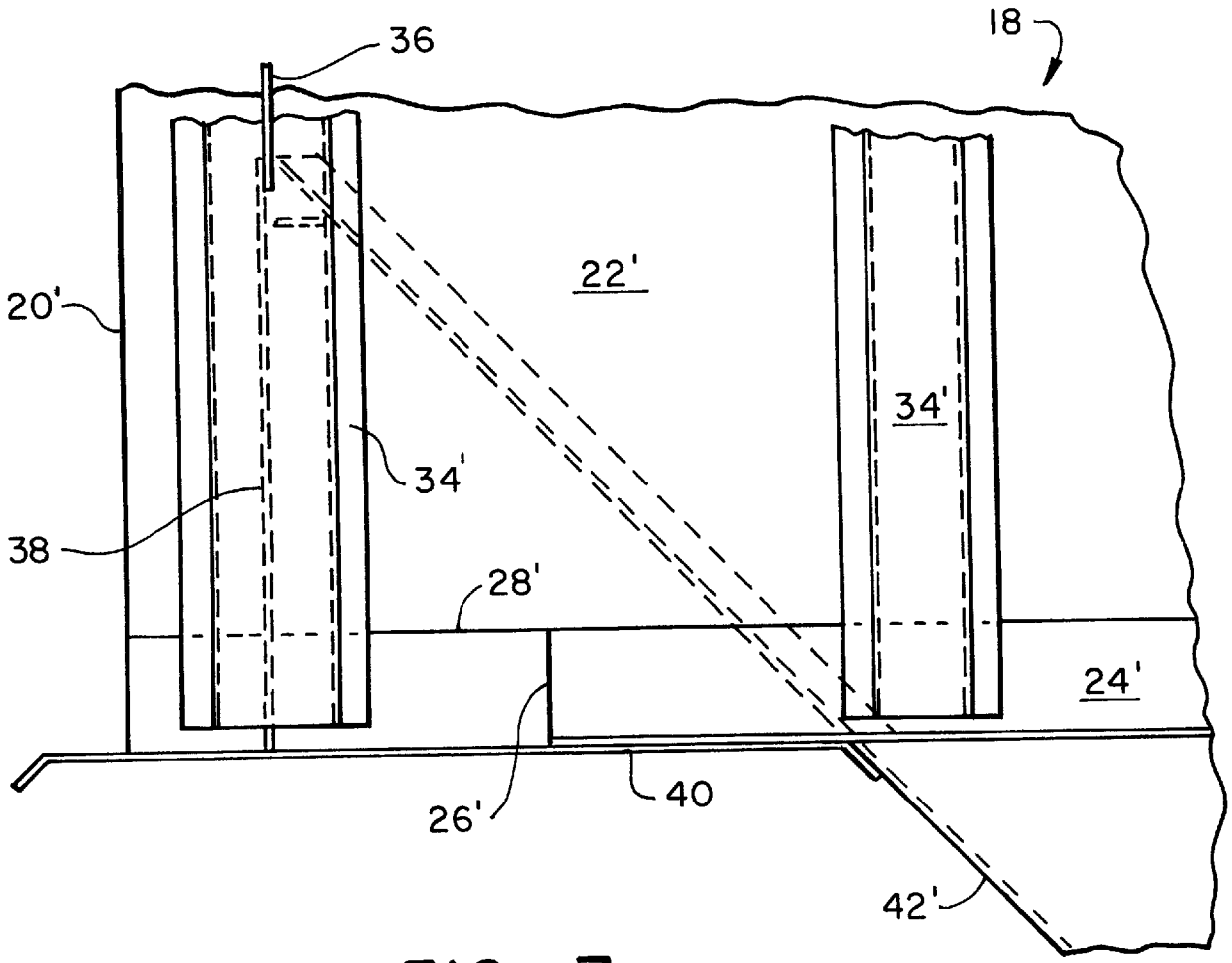
FIG. 7 is a sectional side view schematically illustrating the right section or end hopper after removal of the severed center portion shown in FIG. 1.

FIG. 6 generally illustrates the structure of the left-hand section 14 before attachment of the sections 14 and 18. FIG. 7 generally illustrates the structure of the right-hand section 18 before attachment of the sections 14 and 18. As shown in FIG. 7, the bulkhead 36, which was originally between the end hopper in section 18 and the center hopper in section 16, needs to be extended prior to attachment of the sections 14 and 18. A bulkhead extension 38 is welded in place to lengthen the bulkhead 36. The bulkhead extension 38 extends to a tie gusset 40 that extends between the center sloped sheets 42 of the adjacent discharge chutes in the converted rail car 12. The tie gusset 40 extends from side sill 24 to side sill 24 and between two center sloped sheets 42 forming an important structural component of the converted railcar 10. Vertical tie gussets are added from the tie gusset 40 to the center sill 30 to reinforce the center sloped sheets 42.

FIGS. 8–10 illustrate the splice conditions of the side sheet 22 and 22', top chord 23 and 23', and side sill 24 and 24' in the converted rail car 12. The severed side sheet 22 and 22' and top chord 23 and 23' are welded along the adjacent cuts 20 and 20', and 28 and 28'. A splice plate. 44 is welded across the connection in the top chord 23 and 23' inside the converted rail car 12 as shown in FIG. 9. A weld back plate 46 extends from the splice plate 44 to the horizontal cuts 28 and 28'. The bottom of the side stake 34' of the section 18 can be welded to the tab portion of the section 14 formed by the offset vertical cut 26. A tie plate 48 can be welded to the adjacent side stakes 34 as shown in FIGS. 8–10. The side sill 24 and 24' is welded together as is the center sill 30 and 30'. A splice plate 50 can be positioned across the welded side sill 24 and 24' for reinforcing this connection. One or more splice plates 52 can also be used for reinforcing the attached center sill 30 and 30' as shown in FIG. 11.

Figure 11:
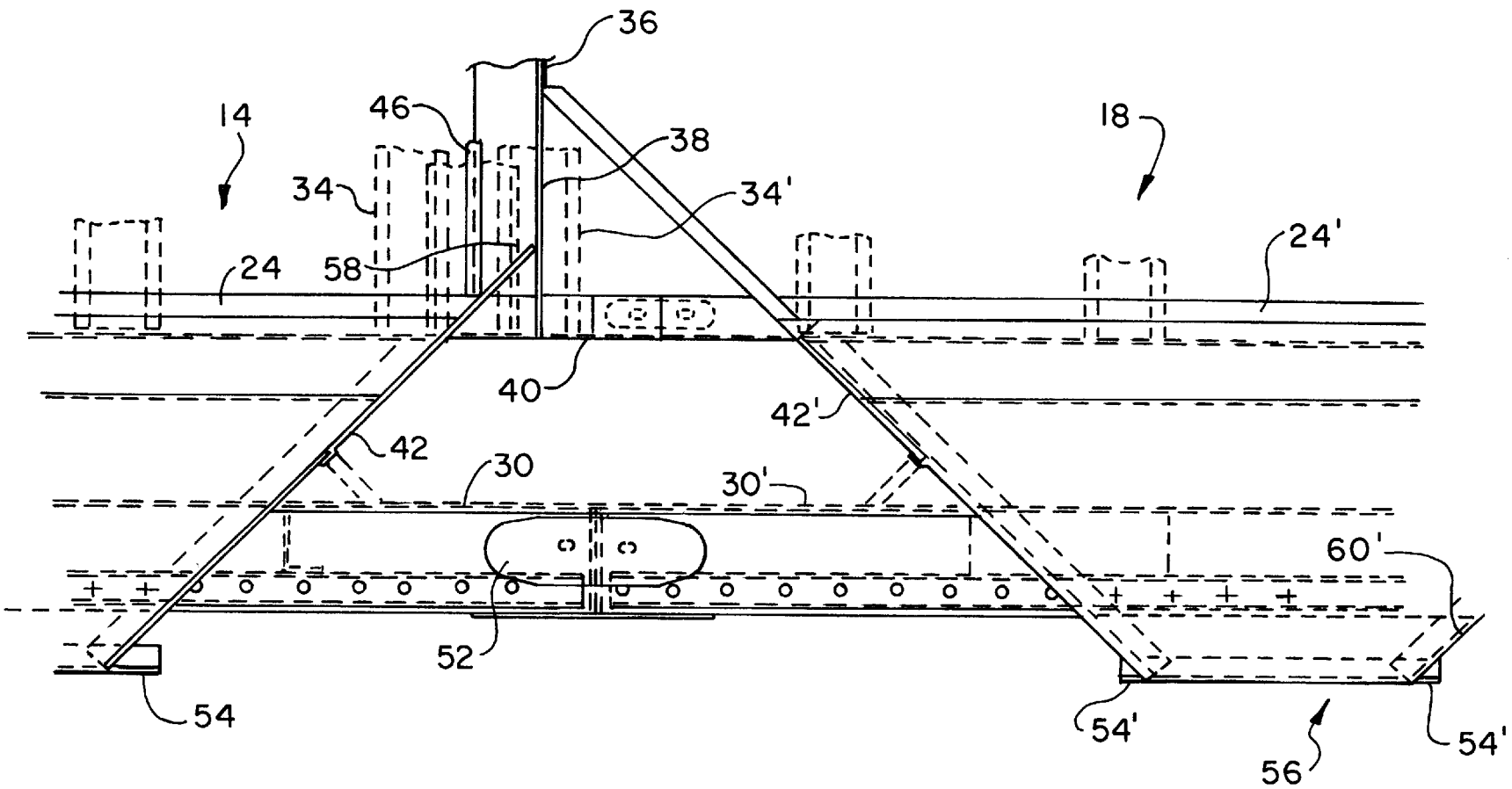
FIG. 11 is a sectional side view of the discharge chute structure between the hoppers in the converted rail car according to the present invention.
Figure 12:
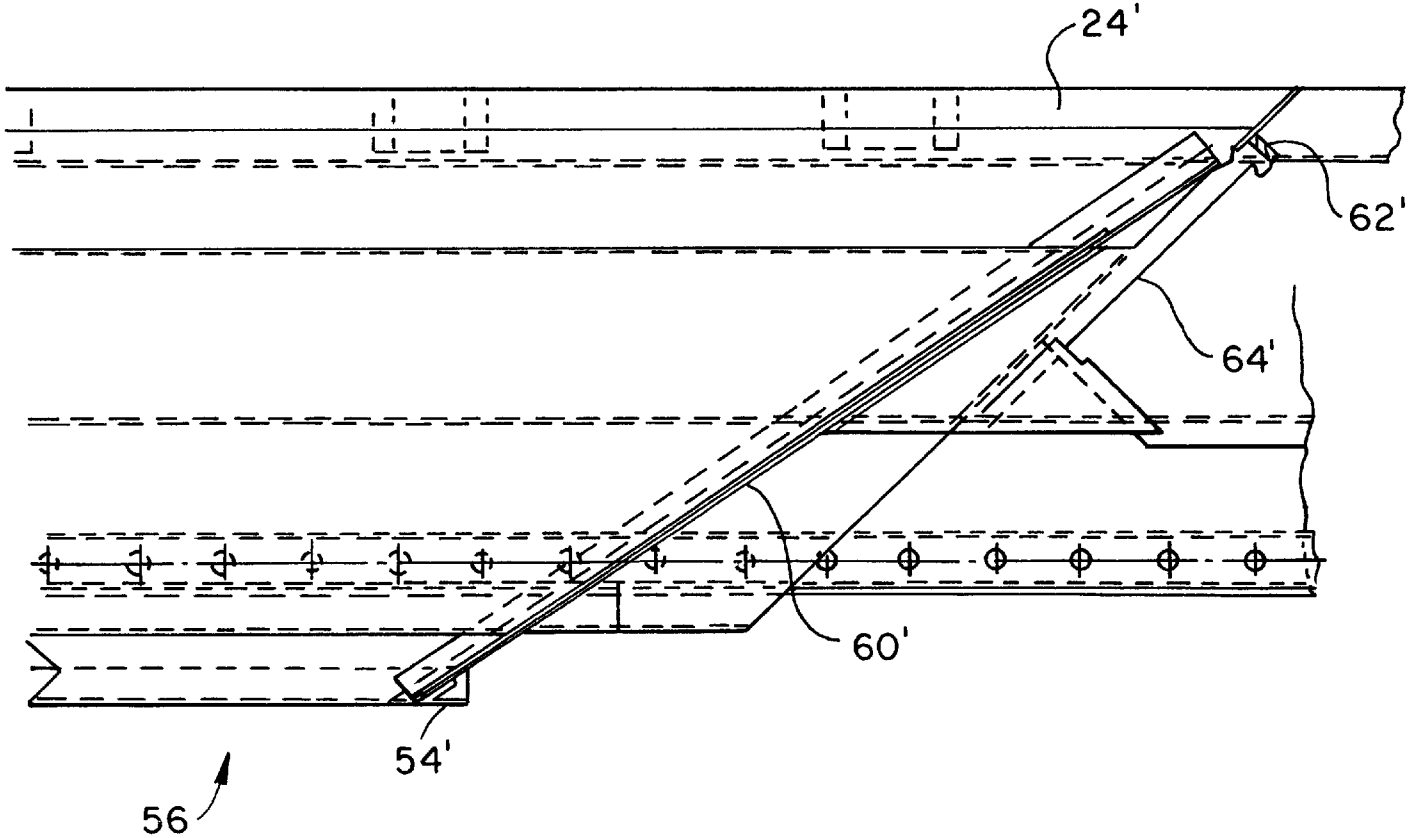
FIG. 12 is a sectional side view of the discharge chute structure at the end of a hopper in the converted rail car according to the present invention.
Figure 13:
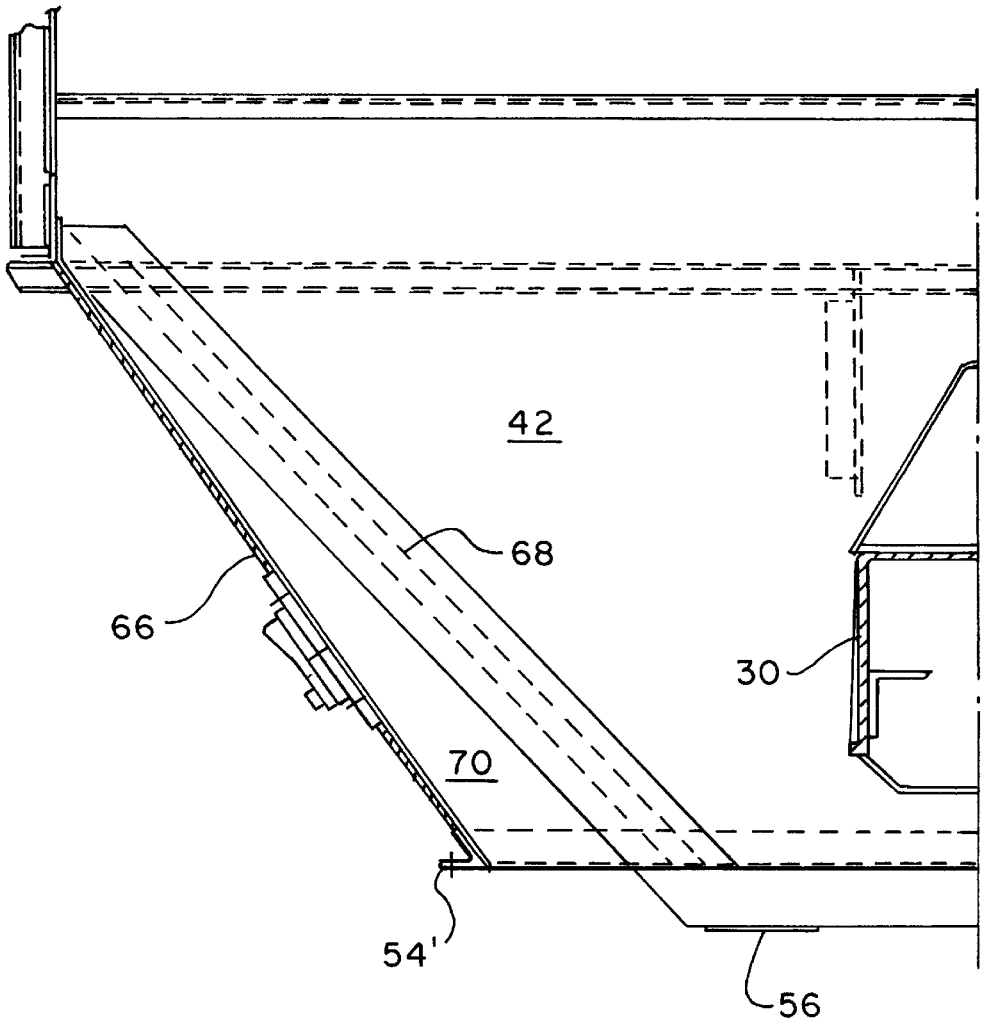
FIG. 13 is a sectional end view of the discharge chute structure of a hopper in the converted rail car according to the present invention.

FIGS. 11–13 illustrate the formation of the discharge chutes in the converted rail car 12. The converted rail car 12 is provided with standard 13"×42" opening, gravity discharge gates 53 and 53' shown in FIG. 14. The new discharge gates 53 are deeper than the grain discharge gate of the rail car 10. The original grain discharge gates are removed in the conversion process. FIGS. 11–13 illustrate the modifications provided to position gate 53 in a standard location. The center sloped sheets 42 and 42' are angled at a 45 degree angle. The center sloped sheet 42' of section 18 extends from the bulkhead 36 to an outlet gate support angle 54'. It is the length of the section 16 that allows the re-use of the existing center sloped sheets from the rail car 10. The center sloped sheets 42 and 42' only require trimming in length due to the new hopper discharge gates 53 and 53'.

This is at a position higher than the original hopper outlet of the rail car 10 that is shown at position 56 in FIG. 11 due to the deeper gate 53. The center sloped sheet 42 of section 14 extends from the bulkhead extension 38 to an outlet gate support angle 54. The center sloped sheet 42 of section 14 is secured to the bulkhead extension 38 through a sealing plate 58.

FIG. 12 illustrates an end sloped sheet 60' for the hopper in section 18. The end slope sheet for the hopper in section 14 is the substantially same. The end slope sheet 60' is set at an angle of 34½ degrees and extends from an outlet gate support angle 54' to a reinforcing plate 62' at the level of the side sill 24'. The position of the end slope sheet 60' is also positioned to raise the hopper opening above the original position 56. This again is due to the relatively deeper gate 53 of the converted rail car 10. A support structure 64 can be included to reinforce the end sloped sheet 60'. Additionally, vertical tie gussets will extend from the center sill 30 to the end sloped sheet 60'. Preferably, the existing vertical gussets can be used with an added extension. The end sloped sheet 60' is a new sheet completely replacing the prior existing sheet in the rail car 10. The prior sheet has been cut off from the bottom of the side sill 24 and 24' to the original outlet gate.

FIG. 13 illustrates a side sloped sheet 66 for the hopper in sections 14 and 18. The converted rail car 12 uses the side slope sheets of the rail car 10. Each side sloped sheet 66 is set at an angle of 53 degrees, which is steeper than the positioning of the side sloped sheet in the rail car 10. The side sloped sheet 66 is cut from the center sloped sheet 42 or 42' along line 68 so that the side sloped sheet can be moved to the proper position as shown in FIG. 13. This repositioning of the side sloped sheet 66 results in a triangular area, which is to be covered by a filler plate 70. On the other side of the side sloped sheet 66, the new end sheet 60 is sized appropriately such that no filler plate is required. The side sloped sheet 66 is attached at its lower end from an outlet gate support angle 54. FIG. 13 also illustrates the position of the outlet gates 53 in the converted rail car 12 relative to the position 56 of the original outlet opening of the rail car 10. The outlet gates 53 are secured to the outlet gate support angles 54 or 54'.

Figure 15:
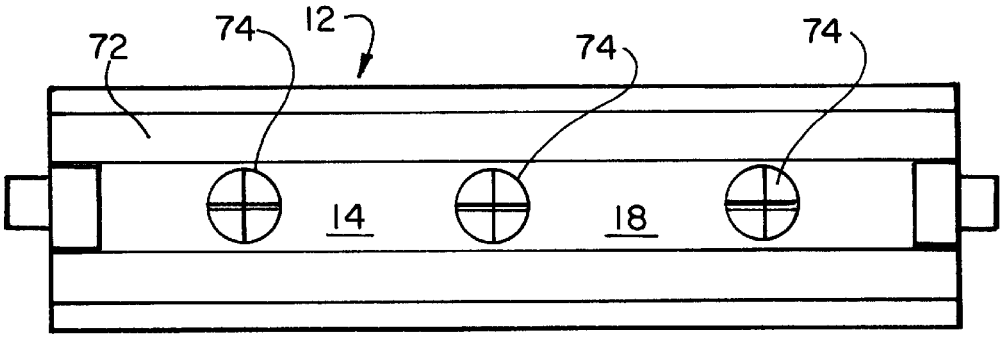
FIG. 15 is a plan view of the rail car illustrated in FIG. 14.
Figure 17:
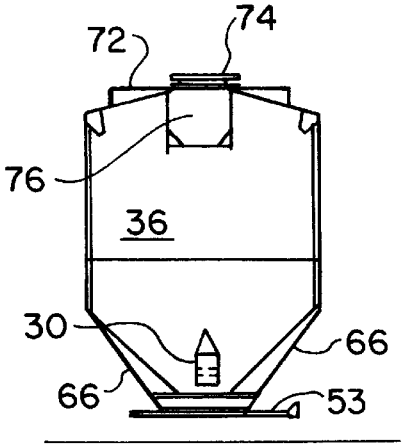
FIG. 17 is a sectional end view of the rail car illustrated in FIG. 14.

A roof assembly 72 with three hatch openings 74 illustrated in FIGS. 14 and 15 complete the construction of the converted rail car 12. The hatch openings are 30" in diameter with one positioned over each hopper and one positioned over the bulkhead 36. In filling the converted rail car 12 with cement powder it is expected that only the hatch opening 74 centered over the bulkhead 36 would be used. As shown in FIG. 17, the bulkhead 36 includes A notch 76 adapted to receive a filling nozzle (not shown) placed within the center hatch opening 74. The cement powder is fluid and self-leveling and easily fills both hoppers. Generally, the two outer hatch openings 74 would be used to assist in the discharge of cement powder. The roof assembly 72 is a new structure replacing existing trough hatch opening in rail car 10. Control equipment, such as braking structures, door actuating mechanisms and the like can be installed and/or reconnected in a conventional fashion. The converted rail car 12 does not significantly effect the positioning or operation of such rail car accessories.

The converted rail car 12 according to the present invention is illustrated in FIGS. 14–17. The converted rail car 12 provides a simpler conversion process than my '237 patent. Additionally, the design of the side stakes 34 adjacent the juncture of the side sheet 22 provide for built in support to the juncture minimizing the reinforcement necessary. The standard positioning of the outlet gates 53 allows the converted rail car 12 to be universally utilized without specialized adapters. The capacity is larger than in the converted rail car of my earlier design. The converted rail car 12 is designed to minimize the new components needed in the conversion process. My '237 patent required striker extensions to meet the AAR prescribed limits of the Cooper Rating. The converted rail car 12 meets the AAR prescribed limits of the Cooper Rating without further modification. This significantly reduces the cost of conversion.

It will be obvious to those of ordinary skill in the art that various changes may be made in the present invention with out departing from the scope thereof. The described preferred embodiment is intended to be illustrative and not restrictive of the present invention. The scope of the present invention is defined by the appended claims and equivalents thereto.

I claim:

1. A converted dual hopper rail car comprising:

a pair of hoppers with each hopper including a discharge opening for discharging contents of the hopper;

a center sill extending along the length of the rail car, the center sill including a welded splice connection;

a pair of top chords, one top chord on each side of the rail car, each top chord extending along the length of the rail car and including a welded splice connection;

a pair of side sills extending along the length of the rail car, one side sill on each side of the rail car, each side sill including a welded splice connection;

a pair of side sheets, one side sheet on each side of the rail car and extending along the length of the rail car, each side sheet including a welded splice connection;

a plurality of side stakes attached to each side sheet extending between one top chord and one side sill; wherein the welded splice connection of each side sheet is adjacent and between a pair of side stakes; and a pair of tie plates, one tie plate extending between the pair of side stakes that are adjacent the welded splice connection of each side sheet.

2. The rail car of claim 1, further including an off-center bulkhead extending between the pair of side sheets separating the pair of hoppers, the bulkhead including an original bulkhead member and a lower bulkhead extension welded to the bulkhead, wherein the bulkhead is offset from and substantially parallel to a center-plane of the railcar.

3. The rail car of claim 2, further including a pair of center sloped sheets, each center sloped sheet extending from the bulkhead to the discharge opening at an angle of about 45 degrees relative to the longitudinal axis of the rail car wherein the center sloped sheets are vertically offset from each other at the bulkhead.

4. The rail car of claim 3, further including a pair of end sloped sheets, each end sloped sheet extending from the level of the side sills to the discharge opening at an angle of about 35 degrees relative to the longitudinal axis of the rail car, each end slope sheet opposite from one center sloped sheet.

5. The rail car of claim 2, further including a pair of side sloped sheets for each hopper, each side sloped sheet extending from one side sill to the discharge opening at an angle of about 53 degrees relative to horizontal.

6. The rail car of claim 5, wherein each side sloped sheet includes an original sheet and a triangular shaped filler plate.

7. The rail car of claim 1, wherein the rail car is converted from a three-hopper railcar and the outlet openings are positioned higher in the original rail car.

8. The rail car of claim 1, wherein the hopper rail car is covered by a roof in which at least three covered circular hatches are mounted for the two hoppers to permit loading of various materials into the hoppers.

9. The rail car of claim 8, wherein one hatch is centered over a bulkhead separating the hoppers, wherein the one hatch can be used to simultaneously fill both hoppers.

10. The rail car of claim 9, wherein the bulkhead includes a notch aligned with the one hatch and adapted to receive a filling nozzle.

11. The rail car of claim 1, further including splice plates extending across the welded splice connection for the center sill, the top chords, and the side sills, respectively.

12. A method of converting a three-hopper rail car to a two-hopper rail car comprising the steps of:

severing the top chord, side sheets, side sills and a center sill of the three-hopper rail car to provide a first end section, a center section and a second end section, wherein the center section includes the entire center hopper and a portion of an adjacent hopper;

removing the center section; and attaching the first end section to the second end section by splicing the top chord, the side sheets, the side sills and the center sill together, wherein a bulkhead separating the two hoppers in the converted railcar is offset from and substantially parallel to a center-plane of the converted rail car.

13. The method of claim 12, wherein the step of severing the side sheets includes severing the side sheets at a cut line positioned adjacent a side stake.

14. The method of claim 13, wherein the step of attaching the first end section to the second end section includes the step of attaching a tie plate to the side stakes adjacent the cut lines in the side sheet, wherein the tie plate overlaps the cut lines.

15. The method of claim 12, further including the step of raising a discharge opening of each hopper in the first and second end sections.

16. The method of claim 15, further including the step of trimming and adjusting center sloped sheets of the first end section and the second end section.

17. The method of claim 15, further including the step of adjusting side sloped sheets of the first end section and the second end section.

18. The method of claim 17, further including the step of adding a filler plate to each side sloped sheet.

19. The method of claim 12, further including the step of adding a roof with three hatches to the reattached first end section and second end section, one hatch aligned with a bulkhead separating the two hoppers, wherein the one hatch can be used to simultaneously fill both hoppers.

20. A converted dual hopper rail car comprising:

a pair of hoppers with each hopper including a discharge opening for discharging contents of the hopper;

a center sill extending along the length of the rail car, the center sill including a welded splice connection;

a pair of top chords, one top chord on each side of the rail car, each top chord extending along the length of the rail car and including a welded splice connection;

a pair of side sills extending along the length of the rail car, one side sill on each side of the rail car, each side sill including a welded splice connection;

a pair of side sheets, one side sheet on each side of the rail car and extending along the length of the rail car, each side sheet including a welded splice connection; and an off-center bulkhead extending between the pair of side sheets separating the pair of hoppers, wherein the bulkhead is offset from and substantially parallel to a center-plane of the railcar.

21. The rail car of claim 20 further including a pair of center sloped sheets extending from opposite sides of the bulkhead, wherein the center sloped sheets are vertically offset from each other at the bulkhead.

22. The railcar of claim 20 wherein the hopper rail car is covered by a roof with one covered circular hatch centered over the off center bulkhead separating the hoppers, wherein the one hatch can be used to simultaneously fill both hoppers.

23. The rail car of claim 22, wherein the bulkhead includes a notch aligned with the one hatch and adapted to receive a filling nozzle.

24. The railcar of claim 20 further including a plurality of side stakes attached to each side sheet extending between one top chord and one side sill; wherein the welded splice connection of each side sheet is adjacent and between a pair of side stakes; and a pair of tie plates, one tie plate extending between the pair of side stakes that are adjacent the welded splice connection of each side sheet.

* * * * *

UNITED STATES PATENT AND TRADEMARK OFFICE

CERTIFICATE OF CORRECTION

PATENT NO. : 6,502,518 B1 
DATED : January 7, 2003
INVENTOR(S) : Roy W. Miller

It is certified that error appears in the above-identified patent and that said Letters Patent is hereby corrected as shown below:

Column 4,
Line 39, "plate. 44" should read -- plate 44 -- (delete period).

Column 7,
Line 14, "A method" should read -- A process --.
Lines 14-15, "car to a two-hopper rail car comprising" should read -- car having a center hopper and a pair of adjacent hoppers to form a converted two-hopper rail car having two hoppers comprising --.
Line 16, "severing the" should read -- severing a --.
Line 25, "converted railcar is" should read -- converted two hopper rail car is --.
Lines 26-27, "the converted rail car" should read -- the converted two hopper rail car --.

Column 8,
Line 42, "one tie plate extending" should read -- each of the pair of tie plates extending --.

Signed and Sealed this

Sixth Day of May, 2003

JAMES E. ROGAN
*Director of the United States Patent and Trademark Office*